US007905576B2

(12) United States Patent
Kusunoki

(10) Patent No.: US 7,905,576 B2
(45) Date of Patent: Mar. 15, 2011

(54) LIQUID EJECTION APPARATUS AND IMAGE FORMING APPARATUS

(75) Inventor: Naoki Kusunoki, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 952 days.

(21) Appl. No.: 11/806,942

(22) Filed: Jun. 5, 2007

(65) Prior Publication Data

US 2007/0291090 A1 Dec. 20, 2007

(30) Foreign Application Priority Data

Jun. 14, 2006 (JP) ..... 2006-165116

(51) Int. Cl.
*B41J 2/05* (2006.01)

(52) U.S. Cl. ..... 347/56

(58) Field of Classification Search ..... 347/47, 347/54, 55, 56, 65, 66
See application file for complete search history.

(56) References Cited

U.S. PATENT DOCUMENTS 4,801,955 A * 1/1989 Miura et al. ..... 347/55
5,119,116 A * 6/1992 Yu ..... 347/65
5,387,314 A * 2/1995 Baughman et al. ..... 216/27
6,048,055 A * 4/2000 Hakkaku ..... 347/86
6,158,843 A * 12/2000 Murthy et al. ..... 347/47
6,472,125 B1 * 10/2002 Koide et al. ..... 430/320
6,702,433 B2 * 3/2004 Kono ..... 347/85
6,910,760 B2 * 6/2005 Kubota et al. ..... 347/56
2004/0008239 A1 1/2004 Kubota et al.
2006/0098051 A1 5/2006 Kubota et al.

FOREIGN PATENT DOCUMENTS

JP 2004-42395 A 2/2004

* cited by examiner

*Primary Examiner* — Anh T. N. Vo
(74) *Attorney, Agent, or Firm* — Birch, Stewart, Kolasch & Birch, LLP

(57) ABSTRACT

The liquid ejection apparatus includes: a nozzle plate in which a nozzle is formed; a substrate which is opposite to the nozzle plate and is provided with a heat generating element; a bubble generation chamber which has an internal diameter greater than an internal diameter of the nozzle, at a boundary between the bubble generation chamber and the nozzle plate; a liquid storage chamber which stores liquid to be supplied to the bubble generation chamber through a supplying channel; a heat generating element drive device which drives the heat generating element to generate and expand an ejection bubble in the liquid in the bubble generation chamber so that the liquid in the bubble generation chamber is ejected from the nozzle by means of the ejection bubble; and an air bubble incorporation unit which incorporates air bubbles into the liquid stored in the liquid storage chamber.

6 Claims, 11 Drawing Sheets

LIQUID EJECTION APPARATUS AND IMAGE FORMING APPARATUS

BACKGROUND OF THE INVENTION

1. Field of the Invention

The present invention relates to a liquid ejection apparatus (mechanism) and an image forming apparatus, and more particularly to a liquid ejection apparatus including an ink supply system and a serial head connected with a sub tank for supplying ink, the sub tank being connected to a main tank for supplying the ink.

2. Description of the Related Art

In recent years, due to requirements for higher image quality, particular emphasis has been given to research into stabilizing the ejection volume of liquid droplets and improving the accuracy of the depositing positions. Japanese Patent Application Publication No. 2004-42395 discloses technology of stabilizing the flight direction of the ink droplets. FIGS. 11A to 11E are diagrams showing the progress of the ejection of ink from a nozzle according to Japanese Patent Application Publication No. 2004-42395. As shown in FIGS. 11A to 11E, a second bubble generation chamber 26B which abuts against a nozzle plate 40 (orifice substrate), is provided. Thereby, the ink that is to be ejected through expansion of an ejection bubble 48 is prevented from reversely flowing into the supply flow channel, the ejection speed of an ink droplet 50 is increased, and also the flight direction of the ink droplet 50 is stabilized.

However, in the inkjet printer described in Japanese Patent Application Publication No. 2004-42395, since the second bubble generation chamber 26B abutting against the nozzle plate 40 is provided as shown in FIGS. 11A to 11E, then a liquid pool 70 occurs at the corner sections of the second bubble generation chamber 26B when the expansion of the ejection bubble 48 progresses to a state (shown in FIG. 11B) immediately before the ejection bubble 48 is incorporated into the atmosphere. Hence, when the ejection bubble 48 is discharged and is incorporated into the atmosphere (FIGS. 11D and 11E), then the liquid pool 70 is also discharged in the form of a droplet, resulting in the generation of a satellite droplet 52. The frequency of occurrence of dot disturbance may be thereby increased, and consequently, it is difficult to achieve the desired dot shape.

SUMMARY OF THE INVENTION

The present invention has been contrived in view of these circumstances, an object thereof being to provide a liquid ejection apparatus which prevents the occurrence of a liquid pool at the corner sections of a bubble generation chamber so that a satellite droplet is not generated when liquid is ejected from a nozzle.

In order to attain the aforementioned object, the present invention is directed to a liquid ejection apparatus comprising: a nozzle plate in which a nozzle is formed; a substrate which is opposite to the nozzle plate and is provided with a heat generating element; a bubble generation chamber which has an internal diameter greater than an internal diameter of the nozzle, at a boundary between the bubble generation chamber and the nozzle plate; a liquid storage chamber which stores liquid to be supplied to the bubble generation chamber through a supplying channel; a heat generating element drive device which drives the heat generating element to generate and expand an ejection bubble in the liquid in the bubble generation chamber so that the liquid in the bubble generation chamber is ejected from the nozzle by means of the ejection bubble; and an air bubble incorporation unit which incorporates air bubbles into the liquid stored in the liquid storage chamber.

In this aspect of the present invention, the air bubbles are intentionally incorporated into the liquid in the liquid storage chamber by the air bubble incorporation unit, thereby increasing the content ratio of the air bubbles in the liquid. Hence, while the liquid is pushed by the ejection bubble generated by the heat generating element and is ejected from the nozzle in the form of a liquid droplet, the air bubbles incorporated into the liquid coalesce into an air pool at a corner section of the bubble generation chamber at the vicinity of the nozzle plate (at the boundary between the nozzle plate and the bubble generation chamber). Therefore, the liquid pool section does not occur, and accordingly it is possible to prevent the occurrence of the satellite droplets. Consequently, an image can be formed by means of dots having desired shapes.

Preferably, the bubble generation chamber includes: a first bubble generation chamber section in which the ejection bubble is generated by the heat generating element; and a second bubble generation chamber section which is interposed between the nozzle plate and the first bubble generation chamber section and regulates a flow direction of the liquid caused by the ejection bubble to be a direction toward the nozzle.

In this aspect of the present invention, the direction of the liquid flow due to the expansion of the ejection bubble is restricted to the direction toward the nozzle in the second bubble generation chamber, and hence the ejection efficiency of the liquid is improved and it is possible to achieve greater stability of the ejection volume.

Preferably, the air bubble incorporation unit includes a porous member disposed in the liquid storage chamber.

In this aspect of the present invention, when the liquid in the liquid storage chamber is consumed due to the liquid supply to the bubble generation chamber and the liquid storage chamber is then replenished with the liquid in accordance with the liquid ejection from the nozzle, then air is absorbed in the air bubble incorporation unit constituted by the porous member disposed in the liquid storage chamber, and the absorbed air is incorporated into the liquid in the liquid storage chamber and the bubble generation chamber, in the form of air bubbles. Consequently, it is possible to incorporate the air bubbles into the liquid in the bubble generation chamber, in a reliable fashion, by means of a simple structure. Therefore, the liquid pool section is reliably prevented from occurring, and hence it is possible to prevent the occurrence of the satellite droplets and an image can be formed by means of dots having desired shapes.

The air bubble incorporation member may be disposed in any position inside the liquid storage section, and desirably, the air bubble incorporation member is disposed in a position such that the air and liquid can pass through the air bubble incorporation member and the air bubbles are thereby incorporated into the liquid in a reliable fashion even in the case of minute increase or decrease in the amount of liquid in the liquid storage section. For example, in the case of a composition in which the bubble generation chamber and the nozzle are disposed below the liquid storage chamber and the liquid for supply flows in a downward direction, if the air bubble incorporation member is disposed in an upper (uppermost) position in the liquid storage chamber, the circumstances of the air bubble incorporation member are changeable even during little increase or decrease in the amount of liquid. Therefore, it is preferable that the air bubble incorporation member is disposed in an upper (uppermost) position in the liquid storage chamber, since change in the liquid level is liable to cause the air bubbles incorporation even during minute increase or decrease in the amount of liquid.

Preferably, the air bubble incorporation unit includes: a filter member; and a pump which supplies the air bubbles to the liquid in the liquid storage chamber through the filter member.

In this aspect of the present invention, by supplying air bubbles from the pump through the filter member, air is incorporated into the liquid in the liquid storage chamber and the bubble generation chamber, in the form of air bubbles. Therefore, it is possible to incorporate the air bubbles into the liquid in the bubble generation chamber, in a reliable fashion. Consequently, the liquid pool section is reliably prevented from occurring, and therefore it is possible to prevent the occurrence of the satellite droplets and an image can be formed by means of dots having desired shapes.

Preferably, the second bubble generation chamber section has a tapered shape to regulate the flow direction of the liquid caused by the ejection bubble to be the direction toward the nozzle.

In this aspect of the present invention, the second bubble generation chamber section has a tapered shape, and therefore, the ejection efficiency of the liquid can be improved more reliably and greater stability of the ejection volume can be achieved.

Preferably, a following condition is satisfied: $(D2-D1)/16 \leqq d \leqq D1/8$, where d is a diameter of the air bubbles incorporated in the liquid by the air bubble incorporation unit, D1 is the internal diameter of the nozzle, and D2 is the internal diameter of the bubble generation chamber at the boundary between the bubble generation chamber and the nozzle plate.

In this aspect of the present invention, it is possible to cause the air bubbles incorporated into the liquid to combine together efficiently, thereby generating the air pool at the corner section of the bubble generation chamber in the vicinity of the nozzle plate (at the boundary between the nozzle plate and the bubble generation chamber), and hence the generation of the satellite droplets can be prevented effectively at the same time as improving the ejection characteristics.

Since the diameter d of the air bubbles to be incorporated into the liquid by the air bubble incorporation unit has a correlation with the pore diameter of the air bubble incorporation unit, then it is possible to adjust the diameter of the air bubbles to be incorporated into the liquid by appropriately selecting the pore diameter of the air bubble incorporation unit.

In order to attain the aforementioned object, the present invention is also directed to an image forming apparatus comprising any one of the liquid ejection apparatuses described above.

According to the present invention, the occurrence of the liquid pool at a corner section of the bubble generation chamber is prevented, and hence the occurrence of a satellite droplet can be prevented when the liquid is ejected from the nozzle.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Preferred embodiments of the present invention are described below with reference to the accompanying drawings. In the present specification, the "upward" direction in the liquid ejection apparatus indicates a direction toward an air connection channel, whereas the "downward" direction indicates a direction toward an ejection head (hereinafter referred to also as "head").

Description of Ink Supply System

Figure 1:
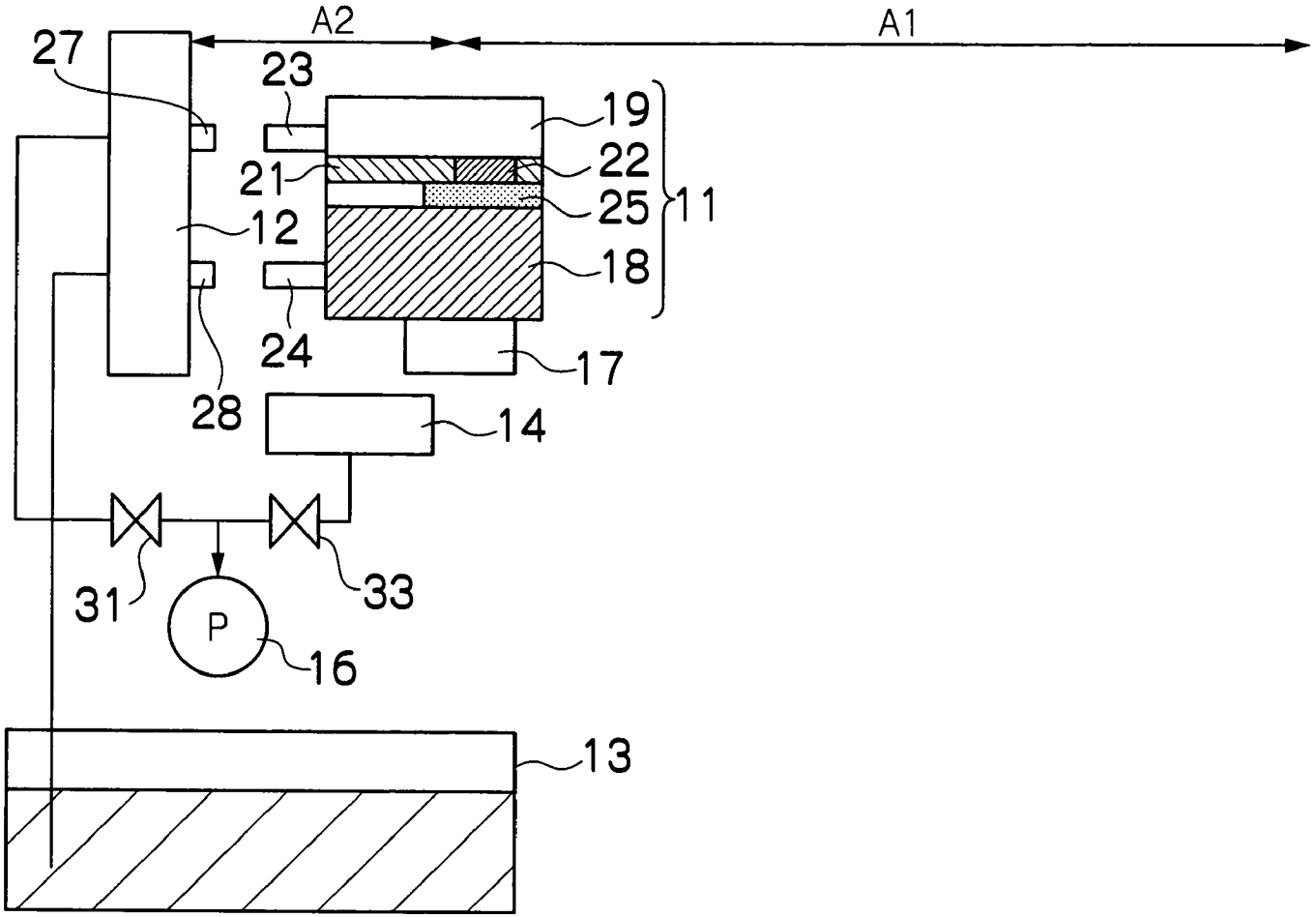
FIG. 1 is a general schematic drawing of a liquid ejection apparatus in which an ink supply system is provided with a liquid ejection mechanism, according to an embodiment of the present invention.

FIG. 1 is a general schematic drawing of a liquid ejection apparatus in which an ink supply system is provided with a liquid ejection mechanism, according to an embodiment of the present invention.

As shown in FIG. 1, the liquid ejection apparatus includes a head 17 (liquid ejection mechanism), a coupling unit 12, a main tank 13, a sub tank 11, a cap unit 14, a suction pump 16, and the like.

The sub tank 11 includes: an ink storage section 18 which forms a liquid storage chamber for storing ink; and an air connection channel 19 which serves as a connection path to the atmosphere. A dividing plate 21 is interposed between the ink storage section 18 and the air connection channel 19. The ink storage section 18 is provided for each color, and a relatively small quantity of ink, corresponding to an amount for printing images on several sheets or several tens of sheets, is stored in the ink storage section 18 provided for each color.

A connection port is provided in the dividing plate 21, and the connection port is filled with an air-liquid separating member 22 through which only air to pass and liquid is inhibited from passing. The air-liquid separating member 22 has a surface which is adjacent to the ink storage section 18 (is located on the side of the ink storage section 18) and coated with a hydrophobic material. A plurality of fine pores are formed in the air-liquid separating member 22 so that air can pass through the air-liquid separating member 22, and these fine pores are formed by laser processing using irradiation of laser light. Furthermore, the air-liquid separating member 22 may be a multifilament fiber body formed by bonding together sheets made of a fibrous resin, a fibrous metal, or the like, to form a laminated body, and then calcining this laminated body.

Moreover, in the present embodiment, an air bubble incorporation member 25 is provided inside the ink storage section 18. The air bubble incorporation member 25 is a porous member that has a function of allowing both air and liquid to pass through the air bubble incorporation member 25. Therefore, air is allowed to pass through the air bubble incorporation member 25 and to be absorbed in the member 25, and moreover, the liquid can also be absorbed in the member 25 due to the capillary force. Consequently, the absorbed air is incorporated into the absorbed liquid in the form of air bubbles. The air bubble incorporation member 25 may be disposed in any position inside the ink storage section 18, and desirably, the air bubble incorporation member 25 is disposed in a position such that the air and ink pass in the air bubble incorporation member 25 and air bubbles can be incorporated into the ink in a reliable fashion even when the amount of the increase or decrease of the liquid level in the ink storage section 18 is minute. In the present embodiment, as shown in FIG. 1, the air bubble incorporation member 25 is disposed in a position such that the air bubble incorporation member 25 is in contact with the dividing plate 21 and the air-liquid separating member 22, which are located above the ink storage section 18. Moreover, the air bubble incorporation member 25 may be formed by injection molding of resin, metal die casting or machining processing.

A suction port 23 for suctioning the air from the exterior is provided with the air connection channel 19, while on the other hand, a supply port 24 for supplying ink from the exterior is provided with each ink storage section 18. The ink storage section 18 is preferably filled with an ink holding member (such as a sponge) in order that the negative pressure of the head 17 can be controlled to a very high degree of accuracy.

During printing, the head 17, which is coupled integrally with the sub tank 11, ejects ink droplets in accordance with image signals while moving reciprocally back and forth over a scanning print region A1 shown in FIG. 1, to form an image on the recording medium (not shown).

Figure 2:
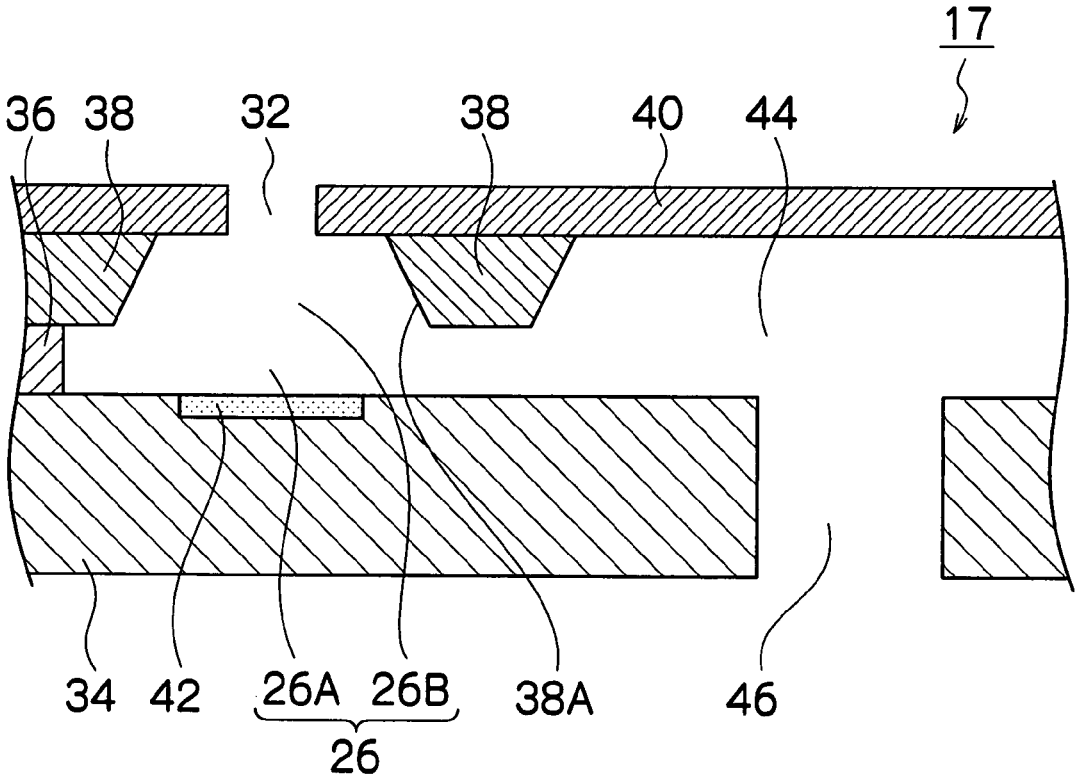
FIG. 2 is a compositional diagram of a recording head according to an embodiment of the present invention.

FIG. 2 is a diagram showing the structure of the head 17. As shown in FIG. 2, the head 17 includes a silicon substrate 34, a first bubble generation chamber forming layer 36, a second bubble generation chamber forming layer 38, a nozzle plate 40, and the like. A state where the nozzle plate 40 is situated in an upper portion of the head 17 is depicted in FIG. 2, whereas in FIG. 1, the nozzle plate 40 is depicted as being located in a lower potion of the head 17.

The silicon substrate 34 is provided with a heater 42 which is a heating element and arranged at a position corresponding to a bubble generation chamber 26 (including a first bubble generation chamber 26A and a second bubble generation chamber 26B) described below. When a prescribed drive signal is supplied to the heater 42, an ejection bubble (a bubble that is generated from evaporation of the ink) is generated and is expanded inside the bubble generation chamber 26 because of the heat generated by the heater 42, and an ink droplet is then ejected from the nozzle 32 because of the pressure created by this ejection bubble. Furthermore, a supply channel 46 and a common flow channel 44 for supplying ink to the bubble generation chamber 26 from the ink storage section 18 of the sub tank 11 are formed in the head 17. The supply channel 46 is formed in the silicon substrate 34.

The first bubble generation chamber forming layer 36 made from a photosensitive resin, or the like, is stacked on the silicon substrate 34, and the first bubble generation chamber 26A is formed in the first bubble generation chamber forming layer 36. The second bubble generation chamber forming layer 38 is stacked on the first bubble generation chamber forming layer 36, and the second bubble generation chamber 26B connected to the first bubble generation chamber 26A is formed in the second bubble generation chamber forming layer 38. The bubble generation chamber 26, which is filled with ink that is to be ejected from the nozzle 32 (before the ejection), is constituted by the first bubble generation chamber 26A and the second bubble generation chamber 26B. The second bubble generation chamber forming layer 38 forms a side wall 38A of the second bubble generation chamber 26B. The side wall 38A is inclined at an angle of approximately 10 to 40 degrees with respect to the central axis of the second bubble generation chamber 26B, and thus forms a circular conical tapered shape in which the internal diameter decreases in terms of a direction toward the nozzle 32. Therefore, in the second bubble generation chamber 26B, the liquid flow direction in which the ink is caused to flow due to the expansion of the ejection bubble 48 is regulated to be a direction toward the nozzle 32, and therefore the ejection efficiency of the ink can be improved and the ejection volume can be stabilized.

Figure 3:
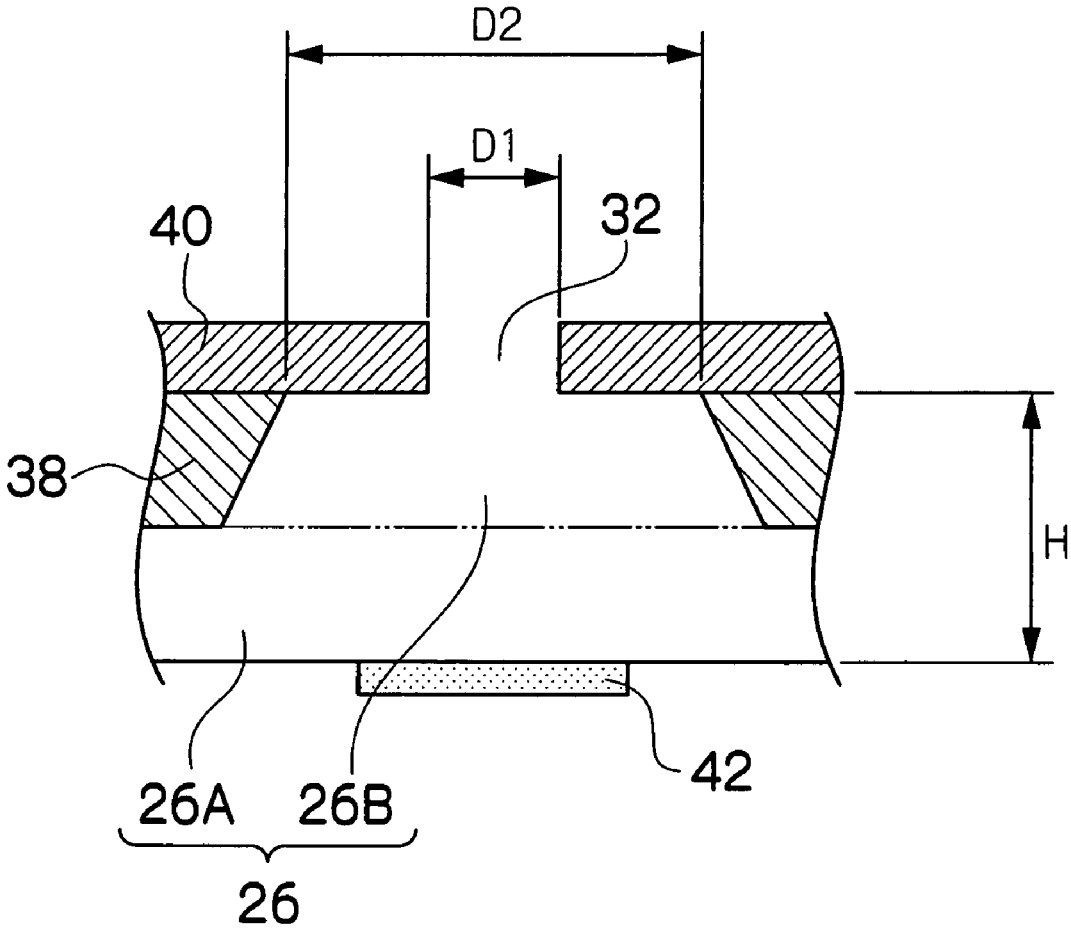
FIG. 3 is a diagram showing the diameter of a nozzle and the internal diameter of a second bubble generation chamber.

The nozzle plate 40 is stacked on the second bubble generation chamber forming layer 38, and the nozzles 32 forming ink ejection ports are formed in this nozzle plate 40. FIG. 3 is a diagram showing the relationship between the diameter of a nozzle and the internal diameter of a second bubble generation chamber at the vicinity of the nozzle plate 40. As shown in FIG. 3, the nozzle 32 has a diameter D1 smaller than the diameter D2 of the second bubble generation chamber 26B formed in the second bubble generation chamber forming layer 38, at the boundary between the second bubble generation chamber forming layer 38 and the nozzle plate 40.

Moreover, as shown in FIG. 1, the coupling unit 12, which forms a supply connection device, is provided with joints 27 and 28. The joint 27 is connected to a suction pump 16, which forms a suction device. On the other hand, the joint 28 is connected to the main tank 13, which is a base tank for storing the ink. A valve (not shown) is provided for each of the joints 27 and 28. A suction tube (not illustrated) is provided in the cap unit 14. By applying a negative pressure with a suction pump 16 through the suction tube in the cap unit 14, the cap unit 14 suctions and expels the ink from the ejection port of the head 17. Moreover, a replenishment port (not illustrated) is provided between the ink storage section 18 and the head 17.

As shown in FIG. 1, a valve 31 for controlling the suctioning from the joint 27, and a valve 33 for controlling the suctioning from the cap unit 14, are connected to the suction pump 16.

The ink supply system having the above-described composition functions as follows.

Firstly, when the remaining amount of ink in the ink storage section 18 in the sub tank 11 becomes low, then the head 17 moves from the scanning print region A1 to a maintenance region A2, and the sub tank 11 is coupled with the coupling unit 12. In this case, the suction port 23 is coupled to the joint 27 that is connected to the suction pump 16 for suctioning air, while on the other hand, the supply port 24 is coupled to the joint 28 that is connected to the main tank 13. In this situation, air passes through and is absorbed in the air bubble incorporation member 25.

Figure 4A:
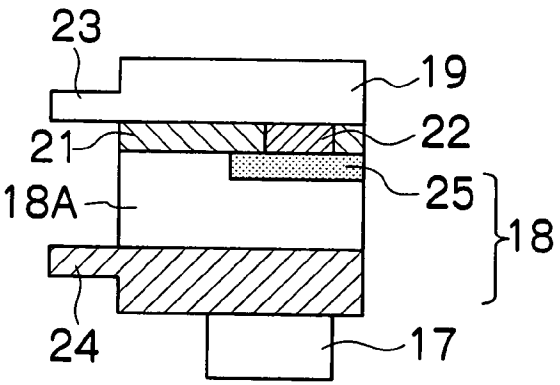
FIGS. 4A to 4C are cross-sectional diagrams for illustrating states of the ink level while ink is being supplied from a main tank to an ink storage section.
Figure 4B:
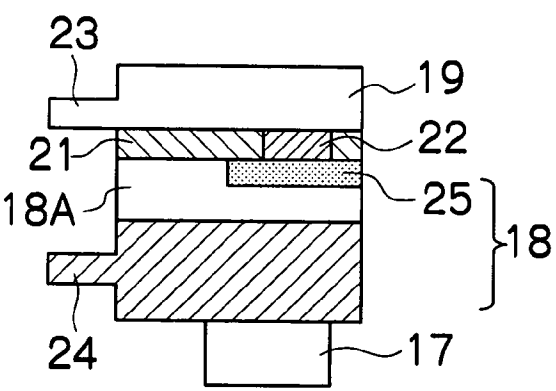
Figure 4C:
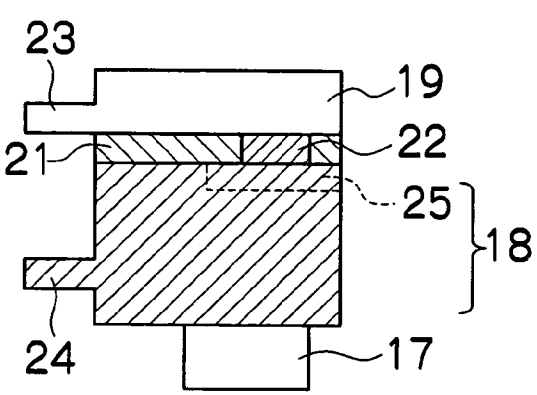

Next, when the valve 31 (shown in FIG. 1) is opened and air suctioning is implemented through the joint 27 and the suction port 23 by means of the suction pump 16, then the pressure in the air connection channel 19 is reduced. FIGS. 4A to 4C are cross-sectional diagrams showing a change in the ink level when the ink is supplied from the main tank 13 to the ink storage section 18. Since air can pass through the air-liquid separating member 22, then an empty region 18A above the liquid surface of the ink (indicated by diagonal hatching) stored in the ink storage section 18 shown in FIG. 4A assumes a reduced pressure state. The ink is therefore supplied from the main tank 13 to the ink storage section 18, through the joint 28 and the supply port 24. As a result of this, the ink level in the ink storage section 18 rises as shown in FIG. 4B, and eventually, as shown in FIG. 4C, the ink level rises to a level such that the air bubble incorporation member 25 is immersed in the ink and the ink liquid surface makes contact with the air-liquid separating member 22. The ink storage section 18 is filled with the ink in this way. In this case, the ink permeates the air bubble incorporation member 25 due to the capillary force, and the air that has been absorbed in the air bubble incorporation member 25 is incorporated into the ink in the form of air bubbles.

When the ink surface in the ink storage section 18 makes contact with the air-liquid separating member 22, then the rise of the ink level is halted since the air-liquid separating member 22 has a function for inhibiting the passage of liquid. The suction force of the suction pump 16 is set to be lower than the liquid passage inhibiting force (liquid repelling force) of the air-liquid separating member 22.

Moreover, a configuration is adopted in which the ink storage sections 18 are arranged in alignment independently for the color inks, and the air connection channel 19 is provided for all the color inks as a single common chamber. In this case, when the suction operation is carried out by the suction pump 16, the ink supply operations from the main tanks 13 are started simultaneously for all the color inks stored in the ink storage sections 18. It is often the case that the remaining ink amount varies between the ink storage sections 18 storing the color inks; however, since the air-liquid separating member 22 has a function for inhibiting the passage of the liquid, as stated previously, then the ink supply terminates sequentially as the ink storage sections of the respective inks become full and the inks comes into contact with the air-liquid separating member 22.

Furthermore, as printing starts and the ink in the ink storage section 18 is consumed, the liquid level of the ink descends in the air bubble incorporation member 25 from a level such that the liquid contacts with the air-liquid separating member 22 and the liquid level further descends in the ink storage section 18. Therefore, the empty region 18A is formed again, air passes through the air bubble incorporation member 25, and consequently the air is absorbed in the air bubble incorporation member 25 again.

In the present embodiment, as shown in FIG. 1 in particular, the air bubble incorporation member 25 is disposed in a position such that the air bubble incorporation member 25 makes contact with the dividing plate 21 and the air-liquid separating member 22. In the present embodiment, the head 17, which is the ink ejection unit, is disposed below the ink storage section 18, and when the ink is ejected and consumed, the liquid surface of the ink inside the ink storage section 18 gradually moves downwards. Since the air bubble incorporation member 25 is disposed in a position such that the air bubble incorporation member 25 is in contact with the dividing plate 21 and the air-liquid separating member 22, then even when the liquid surface of the ink moves slightly downward, the air bubble incorporation member 25 is exposed to the empty region 18A and is able to absorb air therein. Thereupon, when the ink is subsequently supplied to the ink storage section 18 and the ink tank becomes full, then the ink passes through the air bubble incorporation member 25, and the air that has been absorbed in the air bubble incorporation member 25 is incorporated into the ink in the form of air bubbles. As described above, by disposing the air bubble incorporation member 25 in a position in contact with the dividing plate 21 and the air-liquid separating member 22, then even when ink is ejected and supplied in very small amounts, it is still possible to incorporate air bubbles into the ink in a reliable fashion.

By means of the operations described above, air and ink alternately permeate the air bubble incorporation member 25, and the air that has been absorbed in the air bubble incorporation member 25 is thereby incorporated into the ink in the form of air bubbles.

Next, the function and beneficial effects according to the present embodiment are described in more detail with reference to FIGS. 5A to 5E, focusing attention on the head 17. By providing the air bubble incorporation member 25 in the ink storage section 18 as described above, air bubbles are incorporated into the ink and the content ratio of the air bubbles contained in the ink is raised internationally. The ink storage section 18 is connected to the bubble generation chamber 26 (constituted by the first bubble generation chamber 26A and the second bubble generation chamber 26B) via the supply channel 46 (shown in FIG. 2), and the bubble generation chamber 26 is filled with the ink in which the content ratio of the air bubbles is intentionally raised.

Figure 5A:
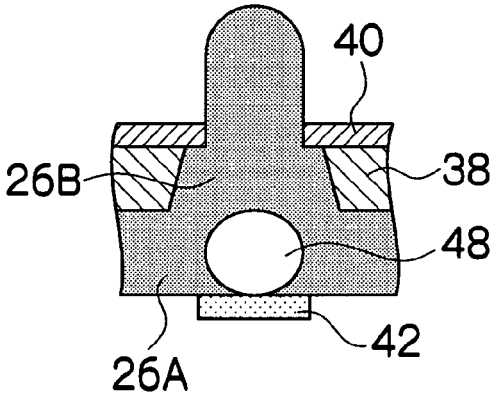
FIGS. 5A to 5E are diagrams showing the progress of the ejection of ink from a nozzle according to an embodiment of the present invention.
Figure 5B:
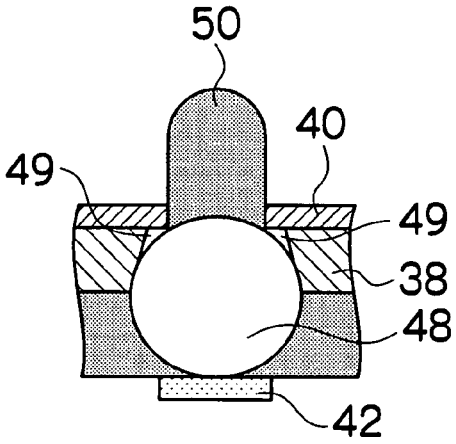

FIGS. 5A to 5E are diagrams showing the progress of the ejection of ink from the nozzle, according to an embodiment of the present invention. When a prescribed drive signal is applied to the heater 42 provided with the silicon substrate 34 so as to generate heat, then as shown in FIG. 5A, an ejection bubble 48 is generated and formed due to the boiling of the ink in the vicinity of the heater 42 inside the first bubble generation chamber 26A. The fine air bubbles contained in the ink are not depicted in FIGS. 5A to 5E. Thereupon, as the heater 42 continues to heat, the ejection bubble 48 is expanded to a larger size as shown in FIG. 5B. In this situation, the ink is pushed by the ejection bubble 48, resulting in the formation of an ink droplet 50 to be ejected from the nozzle 32, whereas the air bubbles contained in the ink coalesce and collect at the corner sections of the second bubble generation chamber 26B shown in FIG. 5B, resulting in the formation of an air pool 49. In this way, by causing the air pool 49 to be formed at the corners of the second bubble generation chamber 26B, it is possible to prevent the occurrence of the liquid pool 70, which is liable to occur in the related art as shown in FIGS. 11A to 11E.

Figure 5C:
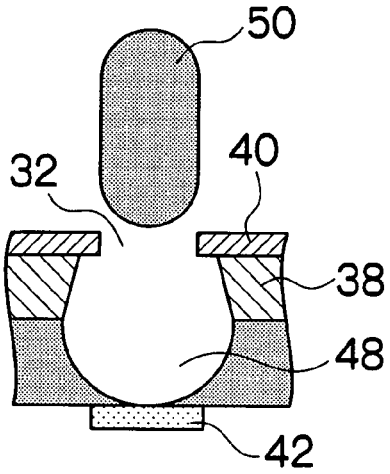

Thereupon, when heat is further generated from the heater 42, as shown in FIG. 5C, the ink droplet 50 is ejected from the nozzle 32 whereas the air pool 49 combines with the ejection bubble 48 and connects with the atmosphere.

Figure 5D:
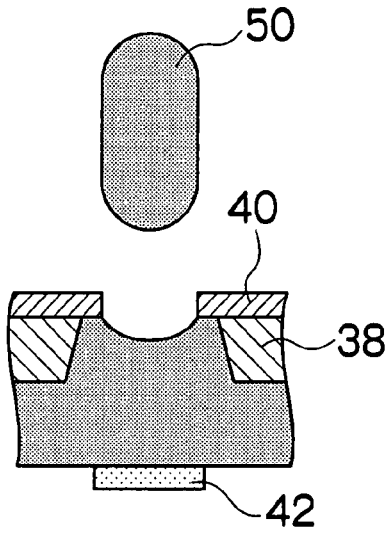
Figure 5E:
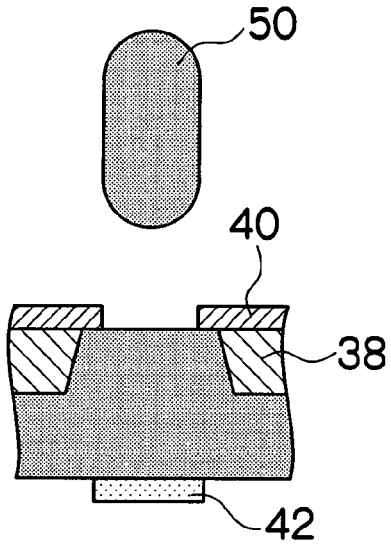

Subsequently, as shown in FIG. 5D, the ink is supplied again to the bubble generation chamber 26. Then, the bubble generation chamber 26 is filled with the ink as shown in FIG. 5E. In this case, as shown in FIGS. 5D and 5E, when the ink droplet 50 is ejected from the nozzle 32, there is no occurrence of the satellite droplet 52 described above with reference to FIGS. 11A to 11E. Consequently, in the present embodiment, it is possible to obtain the desired dot shape.

As described above, it is possible to reliably incorporate the air bubbles into the ink inside the bubble generation chamber 26 by means of a simple structure, and the formation of the liquid pool 70 can be reliably prevented from occurring. Consequently, it is possible to prevent the occurrence of the satellite droplet 52, and an image can be formed by means of dots having desired shapes.

As described above with reference to FIG. 3, the following relationship is satisfied: D2>D1, where D1 represents the diameter of the nozzle 32 and D2 represents the diameter of the wall 38A constituted by the second bubble generation chamber forming layer 38 at a vicinity of the nozzle plate 40 (between the nozzle plate 40 and the wall 38A). In addition to this relationship, the following relationship is preferably satisfied:

$$\{(D2-D1)/16\} \leqq d \leqq (D1/8) \quad (1)$$

where d represents a diameter of the air bubbles incorporated into the bubble generation chamber 26.

In the inequality equation (1), the upper limit value (D1/8) is the limit value for ensuring the ink ejection characteristics from the nozzle 32. If the air bubbles having a larger diameter than this limit value are incorporated into the ink, then there is a possibility that an ejection failure may occur and that the variation in the ejection volume of the ink may increase and the image quality may thus be deteriorated.

Moreover, the lower limit value {(D2−D1)/16} is the lower limit value for achieving effective coalescence of the incorporated air bubbles. If the air bubbles having a smaller diameter than this lower limit value are incorporated into the ink, then it becomes difficult to cause the air bubbles to combine together effectively, the air pool 49 shown in FIG. 5B is not formed, and there is a possibility that the liquid pool may occur.

When air and ink alternately permeate the air bubble incorporation member 25 constituted by a porous member and the air bubbles are thereby incorporated into the ink, then the following relationship is satisfied between the pore diameter in the porous member and the diameter of the air bubbles to be incorporated:

$$g2 \leqq d \leqq g1 \quad (2)$$

where g1 represents the maximum pore diameter of the air bubble incorporation member 25, and g2 represents the minimum pore diameter of the air bubble incorporation member 25. By taking into consideration this relationship, the air bubble incorporation member 25 having the desired pore diameter can be selected so as to adjust the diameter of the air bubbles to be incorporated into the ink.

Figure 6:
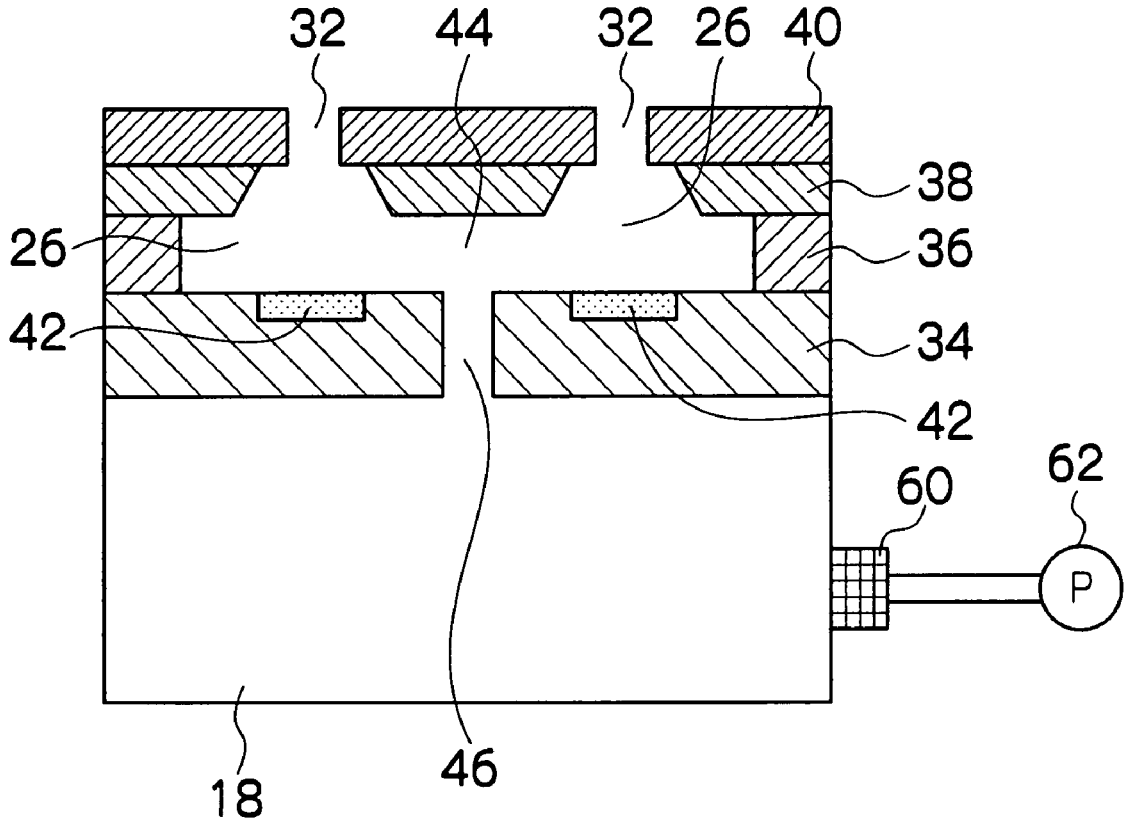
FIG. 6 is a diagram showing an air bubble incorporation unit according to another embodiment of the present invention.

Another possible embodiment for incorporating the air bubbles into the ink is described below. FIG. 6 is a diagram showing another embodiment for incorporating the air bubbles into the ink. As shown in FIG. 6, the ink storage section 18 is supplied with the air bubbles by a pump 62 through a filter member 60, and the ink storage section 18 supplies the ink to the plurality of bubble generation chambers 26. In the present embodiment, air is supplied to the ink storage section 18 through the filter member 60, in the form of fine bubbles, and the air bubbles are thereby incorporated into the ink. In this way, the liquid pool 70 is reliably prevented from occurring, and it is possible to prevent the occurrence of the satellite droplets 52, and hence an image can be formed by means of dots having desired shapes. In the present embodiment also, the inequality equation (1) is satisfied between the diameter D1 of the nozzle 32, the internal diameter D2 of the second bubble generation chamber at the joining part between the nozzle plate 40 and the wall 38A formed by the second bubble generation chamber forming layer 38 (the internal diameter D2 of the wall 38A formed by the second bubble generation chamber forming layer 38 at the vicinity of the nozzle plate 40), and the diameter d of the incorporated air bubbles.

Description of Print Unit

Figure 7:
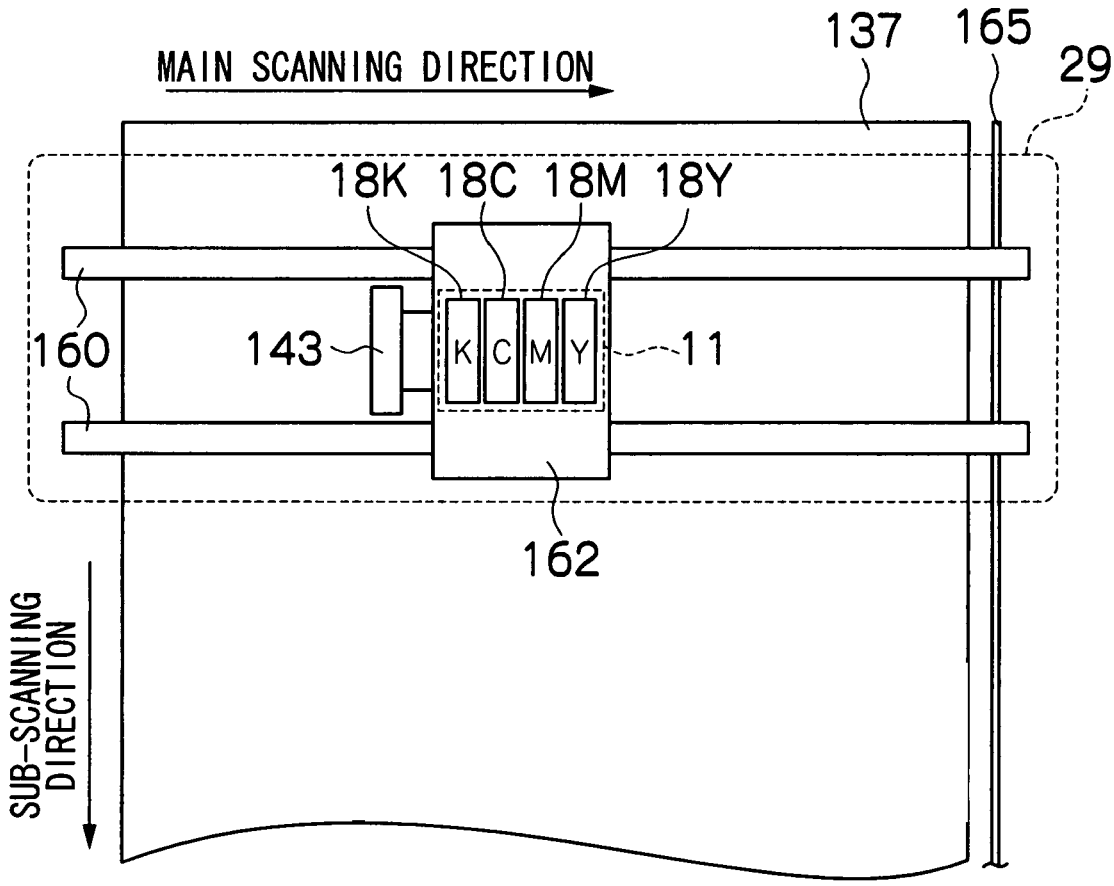
FIG. 7 is a principal plan diagram showing the peripheral area of a print unit of an inkjet recording apparatus according to an embodiment of the present invention.

Next, the print unit including the aforementioned ink supply system is described below. FIG. 7 is a principal plan diagram showing the periphery of a print unit 29 of an inkjet recording apparatus 10. The print unit 29 is provided with a carriage 162 which is movable reciprocally along two guide rails 160 extending in the breadthways direction of the recording paper 137 (the main scanning direction). The sub tank 11 including the ink storage sections 18K, 18C, 18M and 18Y corresponding to the four color inks of black (K), cyan (C), magenta (M) and yellow (Y), and a print determination unit (scanner unit) 143 are detachably mounted on the carriage 162. The sub tank 11 and the print determination unit 143 can move in the main scanning direction in unison with the carriage 162.

The recording paper conveyance amount measurement sensor (conveyance amount sensor) 165 is a device which measures the conveyance amount in the sub-scanning direction of the recording paper 137, and the conveyance amount sensor 165 includes photoelectric sensors arranged following a substantially parallel direction with respect to the sub-scanning direction. The amount of conveyance of the recording paper 137 is measured on the basis of sensor signals obtained from this conveyance amount sensor 165.

Figure 8:
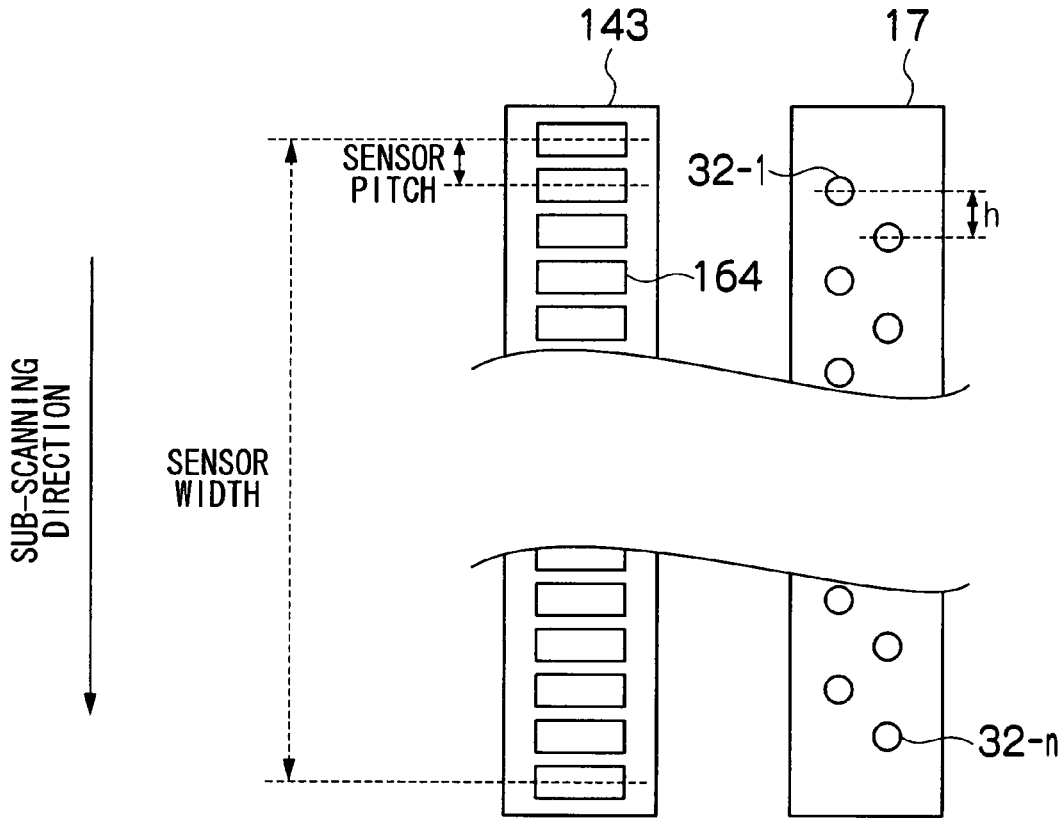
FIG. 8 is an illustrative diagram showing a nozzle face of a head and a sensor face of a print determination unit.

FIG. 8 is an illustrative diagram showing the nozzle surface of the head 17 and the sensor surface of the print determination unit 143. As shown in FIG. 8, a plurality of the nozzles 32 are arranged in a staggered matrix fashion in the head 17, and the nozzle density (nozzle pitch h) in the sub-scanning direction is 1200 nozzles per inch.

As shown in FIG. 8, a plurality of sensors 164 are arranged in a line configuration (a one-dimensional configuration), on the sensor surface of the print determination unit 143. The sensor density (sensor pitch) in the sub-scanning direction is 1200 sensors per inch, which is the same as the nozzle density of the head 17, and the print determination section 143 has a reading resolution of 1200 dpi.

The sensor width (readable width) of the print determination unit 143 is composed to be broader than the nozzle arrangement width (printable width) of the head 17. Accordingly, even when relative displacement (position error) occurs between the head 17 and the print determination unit 143 mounted on the carriage 162 (shown in FIG. 7), the print determination unit 143 is able to read the test pattern formed by the head 17, reliably.

General Composition of Inkjet Recording Apparatus

Figure 9:
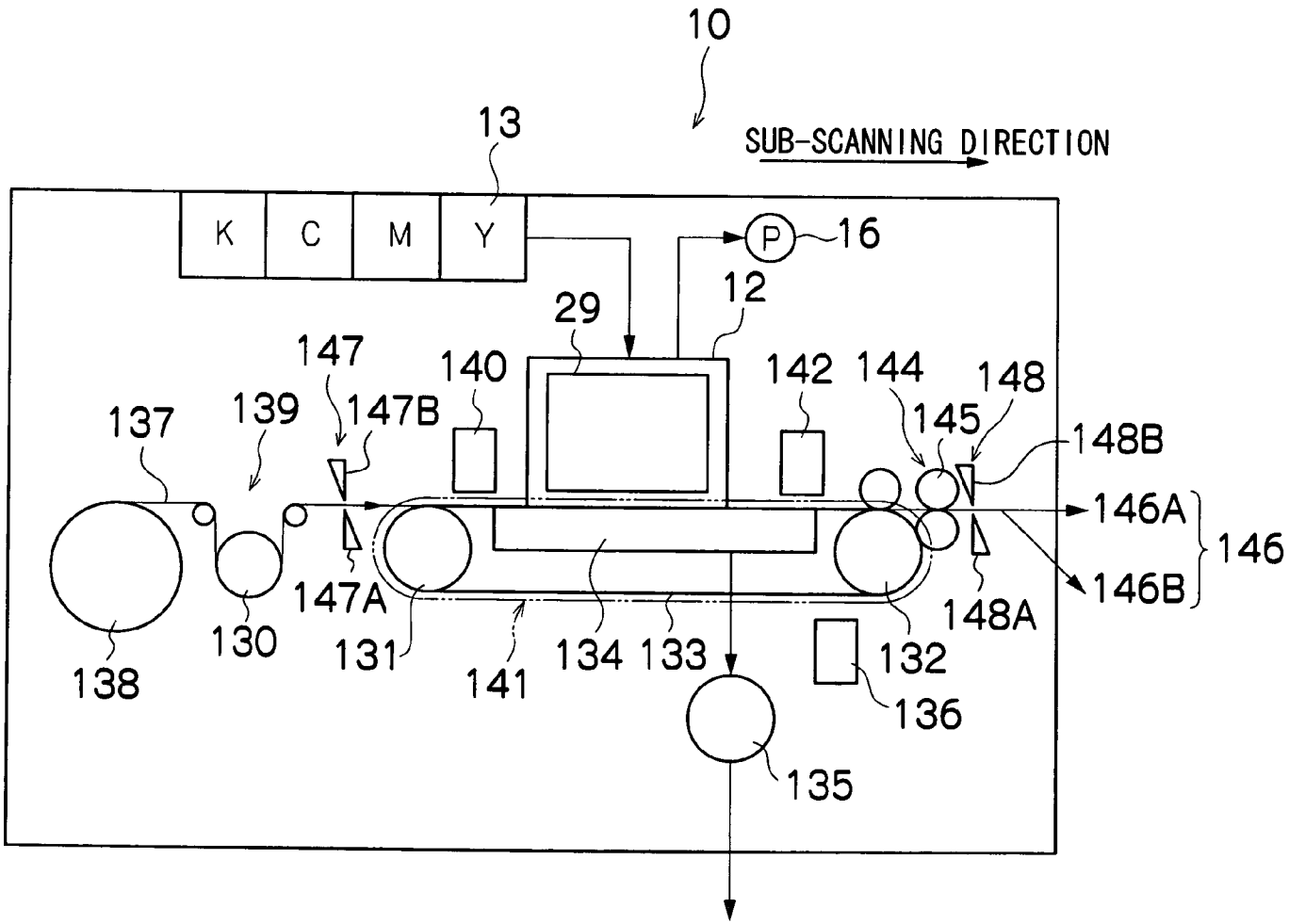
FIG. 9 is a general schematic drawing of the inkjet recording apparatus according to an embodiment of the present invention.

FIG. 9 is a general schematic drawing of an inkjet recording apparatus 10 including the print unit described above. This inkjet recording apparatus 10 includes: the print unit 29, which includes the sub tank 11 having ink storage sections 18K, 18C, 18M and 18Y corresponding to the four ink colors; the main tank 13, which stores the inks to be supplied to the respective ink storage sections 18K, 18C, 18M and 18Y; the coupling unit 12, which couples with the print unit 29 when the inks are supplied to the respective ink storage sections 18K, 18C, 18M and 18Y; the suction pump 16, which is connected to the coupling unit 12; a paper supply unit 138 for supplying a recording paper 137; a decurling processing unit 139 for removing curl from the recording paper 137; a suction belt conveyance unit 141, which is disposed opposing the nozzle surface (ink ejection surface) of the print unit 29 and conveys the recording paper 137 while holding the recording paper 137 flat; the print determination unit 143, which reads in the print results of the print unit 29; and a paper output unit 146, which outputs printed recording paper (printed matter) to the exterior.

In the case of a configuration in which roll paper is used, a cutter 147 is provided as shown in FIG. 9, and the roll paper is cut to a desired size by the cutter 147. The cutter 147 has a stationary blade 147A, whose length is not less than the width of the conveyor pathway of the recording paper 137, and a round blade 147B, which moves along the stationary blade 147A. The stationary blade 147A is disposed on the reverse side of the printed surface of the recording paper 137, and the round blade 147B is disposed on the printed surface side across the conveyance path from the stationary blade 147A.

The recording paper 137 delivered from the paper supply unit 138 retains curl due to having been loaded in the magazine. In order to remove the curl, heat is applied to the recording paper 137 in the decurling unit 139 by a heating drum 130 in the direction opposite to the curl direction in the magazine.

After decurling, the cut recording paper 137 is delivered to the suction belt conveyance unit 141. The suction belt conveyance unit 141 has a configuration in which an endless belt 133 is set around rollers 131 and 132 so that the portion of the endless belt 133 facing at least the nozzle face of the print unit 29 forms a plane.

The belt 133 has a width that is greater than the width of the recording paper 137, and a plurality of suction holes (not shown) are formed on the belt surface. A suction chamber 134 is disposed in a position facing the nozzle surface of the print unit 29 on the interior side of the belt 133, which is set around the rollers 131 and 132, as shown in FIG. 9; and this suction chamber 134 provides suction with a fan 135 to generate a negative pressure, thereby holding the recording paper 137 on the belt 133 by suction. In the region of the print unit 29, the head 17 integrated with the sub tank 11 scans (moves above) the recording paper 137 reciprocally back and forth in the front/rear direction of FIG. 9.

The belt 133 is driven in the clockwise direction in FIG. 9 by the motive force of a motor (not illustrated) being transmitted to at least one of the rollers 131 and 132, which the belt 133 is set around, and the recording paper 137 held on the belt 133 is conveyed in the sub-scanning direction (the paper conveyance direction) in FIG. 9.

Since the ink adheres to the belt 133 when a marginless print job or the like is performed, a belt-cleaning unit 136 is disposed in a predetermined position (a suitable position outside the printing area) on the exterior side of the belt 133. A heating fan 140 is disposed on the upstream side of the print unit 29 in the conveyance pathway formed by the suction belt conveyance unit 141. The heating fan 140 blows heated air onto the recording paper 137 to heat the recording paper 137 immediately before printing so that the ink deposited on the recording paper 137 dries more easily.

The main tank 13 includes tanks which store the color inks to be supplied to the heads 17 corresponding to the respective ink storage sections 18K, 18C, 18M and 18Y of the print unit 29 (shown in FIG. 7). Moreover, the main tank 13 also includes a notifying device (such as a display device, an alarm generating device, or the like) that generates a notification when the remaining amount of ink has become low, and a mechanism for preventing incorrect loading of ink of the wrong color.

The coupling unit 12 shown in FIG. 1 and the print unit 29 are arranged in the main scanning direction of the print unit 29. When the remaining amount of ink in the ink storage section 18 inside the sub tank 11 becomes low, then the head 17 moves from the scanning print region A1 to the maintenance region A2, and the sub tank 11 is coupled with the coupling unit 12. The inks are then supplied to the respective ink storage units 18K, 18C, 18M and 18Y, from the main tank 13, through the coupling unit 12.

As shown FIG. 9, a post-drying unit 142 is disposed following the print unit 29. The post-drying unit 142 is a device to dry the printed image surface, and includes a heating fan, for example.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 146. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 146A and 146B, respectively. When the target print and the test print are simultaneously formed in parallel on the same large sheet of paper, the test print portion is cut and separated by a cutter (second cutter) 148. The cutter 148 is disposed immediately before the paper output unit 146, and is used for cutting the test print portion from the target print portion when a test print has been performed in the blank portion of the target print. The structure of the cutter 148 is the same as the first cutter 147 described above, and has a stationary blade 148A and a round blade 148B.

Description of Control System

Figure 10:
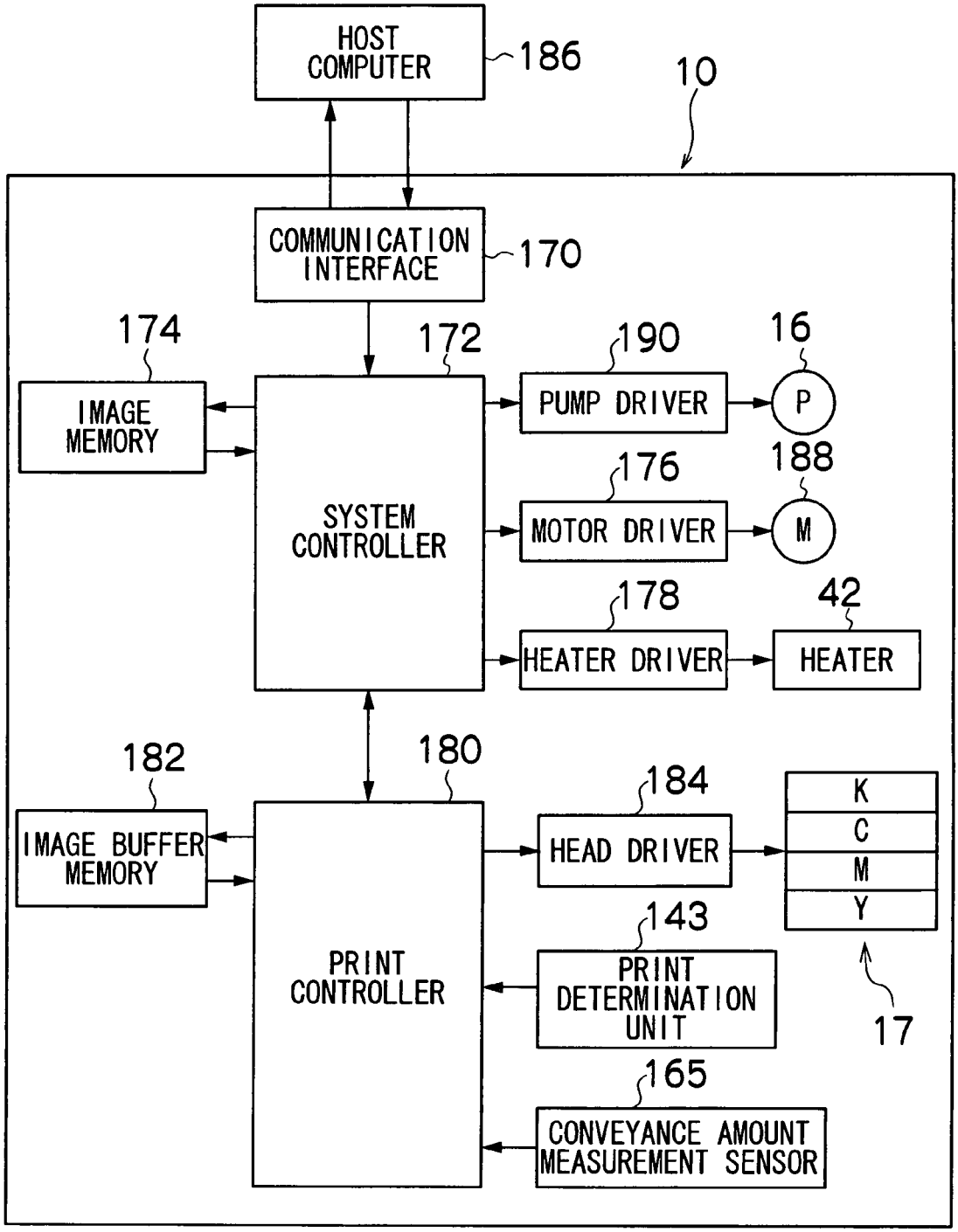
FIG. 10 is a principal block diagram showing the system composition of the inkjet recording apparatus according to an embodiment of the present invention.
Figure 11A:
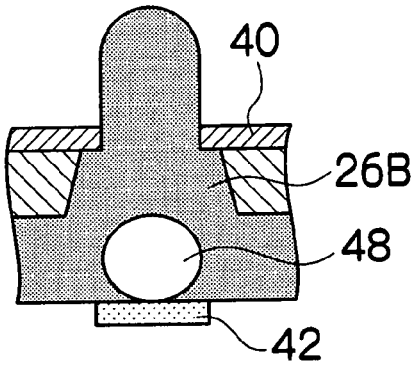
FIG.11A RELATED ART
FIGS. 11A to 11E are diagrams showing the progress of the ejection of ink from a nozzle according to the related art.
Figure 11B:
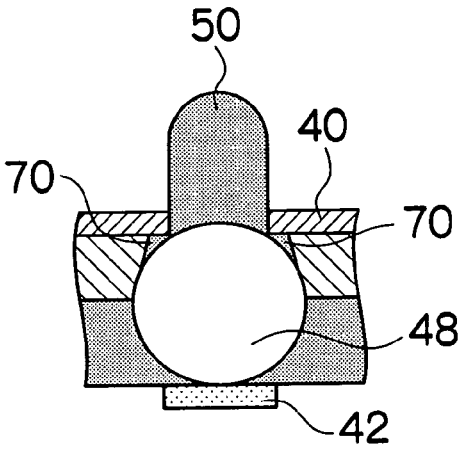
FIG.11B RELATED ART
Figure 11C:
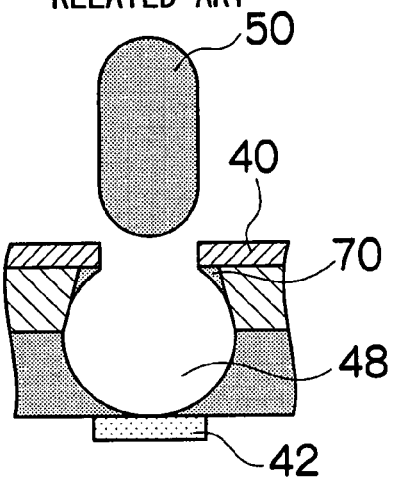
FIG.11C RELATED ART
Figure 11D:
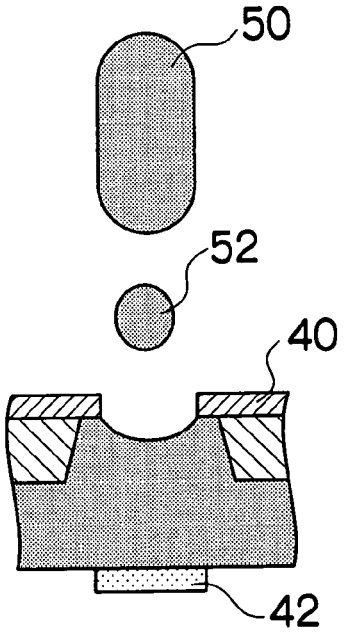
FIG.11D RELATED ART
Figure 11E:
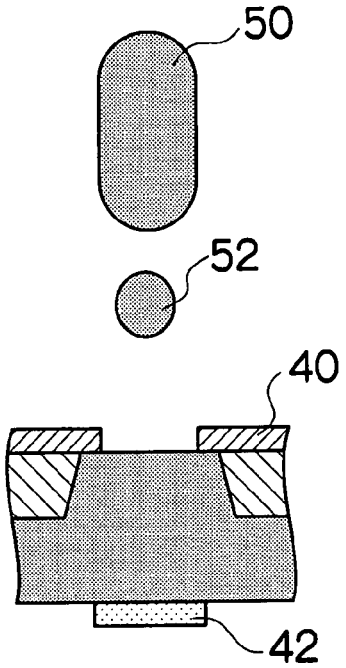
FIG.11E RELATED ART

FIG. 10 is a principal block diagram showing the system configuration of the inkjet recording apparatus 10. The inkjet recording apparatus 10 includes a communication interface 170, a system controller 172, an image memory 174, a motor driver 176, a heater driver 178, a print controller 180, an image buffer memory 182, a head driver 184, a pump driver 190, and the like.

The communication interface 170 is an interface unit for receiving image data sent from a host computer 186. The image data sent from the host computer 186 is received by the inkjet recording apparatus 10 through the communication interface 170, and is temporarily stored in the image memory 174. The image memory 174 is a storage device for temporarily storing an image input via the communication interface 170, and data is written to and read from the image memory 174 via the system controller 172.

The system controller 172 is a control unit for controlling the various sections, such as the communication interface 170, the image memory 174, the motor driver 176, the heater driver 178, and the like. The system controller 172 is constituted by a central processing unit (CPU) and peripheral circuits thereof, and the like, and in addition to controlling communications with the host computer 186 and controlling reading and writing from and to the image memory 174, and the like, it also generates control signals for controlling the heater 42 and the motor 188 in the conveyance system.

The motor driver (drive circuit) 176 drives the motor 188 in accordance with commands from the system controller 172. The heater driver 178 drives the heaters 42 (shown in FIG. 3), a heater in the post-drying unit 142, and the like, in accordance with commands from the system controller 172. The pump driver 190 is a driver which drives the pump 16 in accordance with instructions from the system controller 172.

The print controller 180 has a signal processing function for performing various tasks, compensations, and other types of processing for generating print control signals from the image data stored in the image memory 174 in accordance with commands from the system controller 172 so as to supply generated print control signals (dot data) to the head driver 184. Prescribed signal processing is carried out in the print controller 180, and the ejection amount and the ejection timing of the ink droplets from the respective print heads 17 are controlled by the head driver 184, on the basis of the print data. By this control of the head driver 184, desired dot size and dot positions can be achieved.

The print controller 180 is accompanied with the image buffer memory 182, and image data, parameters, and other data are temporarily stored in the image buffer memory 182 while the image data is processed in the print controller 180.

The heater driver 178 generates drive signals for driving the heaters 42 (shown in FIG. 3) in the heads 17 corresponding to the respective colors on the basis of the print data supplied from the print controller 180, and the drive signals thus generated are transmitted to the heaters 42.

As stated previously, the print determination unit 143 reads in a test pattern recorded by the heads 17, and it performs prescribed signal processing, and the like, in order to determine the ink ejection status of the heads 17 (the presence or absence of ejection, the dot sizes, the dot depositing positions, and the like) (in other words, in order to determine variations between the nozzles 32). The print determination unit 143 supplies the determination results to the print controller 180. According to requirements, the print controller 180 makes various corrections with respect to the heads 17 on the basis of information obtained from the print determination unit 143.

The conveyance amount sensor 165 measures the amount of conveyance of the recording paper 137 in the sub-scanning direction, and the sensor signals (conveyance amount information) obtained from the conveyance amount sensor 165 are supplied to the print controller 180.

The image forming apparatus according to an embodiment of the present invention is described in detail above, but the present invention is not limited to the aforementioned embodiments, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus comprising:

nozzle plate in which a nozzle is formed;

a substrate which is opposite to the nozzle plate and is provided with a heat generating element;

a bubble generation chamber which has an internal diameter greater than an internal diameter of the nozzle, at a boundary between the bubble generation chamber and the nozzle plate;

a liquid storage chamber which stores liquid to be supplied to the bubble generation chamber through a supplying channel;

a heat generating element drive device which drives the heat generating element to generate and expand an ejection bubble in the liquid in the bubble generation chamber so that the liquid in the bubble generation chamber is ejected from the nozzle by means of the ejection bubble; and an air bubble incorporation unit which incorporates air bubbles into the liquid stored in the liquid storage chamber, wherein a following condition is satisfied:

$$(D2-D1)<d<D1/8,$$

where d is a diameter of the air bubbles incorporated in the liquid by the air bubble incorporation unit, D1 is the internal diameter of the nozzle, and D2 is the internal diameter of the bubble generation chamber at the boundary between the bubble generation chamber and the nozzle plate.

2. The liquid ejection apparatus as defined in claim 1, wherein the bubble generation chamber includes:

a first bubble generation chamber section in which the ejection bubble is generated by the heat generating element; and a second bubble generation chamber section which is interposed between the nozzle plate and the first bubble generation chamber section and regulates a flow direction of the liquid caused by the ejection bubble to be a direction toward the nozzle.

3. The liquid ejection apparatus as defined in claim 2, wherein the second bubble generation chamber section has a tapered shape to regulate the flow direction of the liquid caused by the ejection bubble to be the direction toward the nozzle.

4. The liquid ejection apparatus as defined in claim 1 wherein the air bubble incorporation unit includes a porous member disposed in the liquid storage chamber.

5. The liquid ejection apparatus as defined in claim 1, wherein the air bubble incorporation unit includes:

a filter member; and a pump which supplies the air bubbles to the liquid in the liquid storage chamber through the filter member.

6. An image forming apparatus comprising the liquid ejection apparatus as defined in claim 1.

* * * * *